US006851752B2

(12) United States Patent
Asbach

(10) Patent No.: US 6,851,752 B2
(45) Date of Patent: Feb. 8, 2005

(54) HEIGHT ADJUSTMENT MECHANISM FOR AN INFANT SUPPORT STRUCTURE

(75) Inventor: Ronald M. Asbach, Grand Island, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/286,949

(22) Filed: Nov. 4, 2002

(65) Prior Publication Data

US 2004/0084944 A1 May 6, 2004

(51) Int. Cl.[7] ..... A47C 1/06

(52) U.S. Cl. ..... 297/344.12; 297/344.18; 297/463.1; 297/118; 297/119; 248/188.3; 182/204

(58) Field of Search ..... 182/200, 201, 182/202, 203, 204, 205; 248/188.1, 188.2, 188.3, 423, 422, 188.9, 188.8, 157, 161, 404; 472/119; 297/344.18, 344.12, 130, 129, 463.1, 463.2; 108/147.21

(56) References Cited

U.S. PATENT DOCUMENTS

| | | | | |
|---|---|---|---|---|
| 1,505,518 | A | | 8/1924 | Workman, Jr. |
| 2,050,667 | A | | 8/1936 | Moreland |
| 2,331,629 | A | * | 10/1943 | Reilly ..... 297/327 |
| 2,642,121 | A | | 6/1953 | Frick |
| 2,692,637 | A | | 10/1954 | Rainwater |
| 2,731,072 | A | | 1/1956 | Post |
| 2,790,484 | A | | 4/1957 | Pollack |
| 2,910,111 | A | | 10/1959 | Hansburg |
| 2,971,570 | A | | 2/1961 | Vander Bush |
| 3,909,061 | A | | 9/1975 | Johnson |
| 3,913,976 | A | | 10/1975 | Plancher et al. |
| 4,193,630 | A | | 3/1980 | Steele |
| 4,265,481 | A | | 5/1981 | Fleischer |
| 4,671,383 | A | * | 6/1987 | Huang ..... 182/204 |
| 4,946,180 | A | | 8/1990 | Baer |
| 5,044,468 | A | * | 9/1991 | Worthington, Jr. ..... 182/202 |
| 5,165,755 | A | * | 11/1992 | Rho ..... 297/344.18 |
| 5,230,523 | A | | 7/1993 | Wilhelm |
| 5,238,292 | A | | 8/1993 | Golenz et al. |
| 5,348,374 | A | | 9/1994 | Kuo |
| 5,445,432 | A | | 8/1995 | Chien |
| 5,489,138 | A | * | 2/1996 | Mariol et al. ..... 297/151 |
| 5,507,550 | A | | 4/1996 | Maloney |
| 5,509,719 | A | | 4/1996 | Cone, II |
| 5,520,433 | A | * | 5/1996 | Tokutake et al. ..... 297/131 |
| 5,806,922 | A | * | 9/1998 | Mendelovich ..... 297/130 |
| 5,816,364 | A | * | 10/1998 | Christy et al. ..... 182/201 |
| 5,820,207 | A | | 10/1998 | Wang |
| 5,951,102 | A | | 9/1999 | Poulson et al. |
| 6,000,750 | A | * | 12/1999 | Rossman et al. ..... 297/2 |
| 6,050,643 | A | | 4/2000 | Kain et al. |
| 6,073,726 | A | * | 6/2000 | McCrystal ..... 182/195 |
| 6,089,653 | A | * | 7/2000 | Hotaling et al. ..... 297/130 |
| 6,095,607 | A | * | 8/2000 | Wenzel ..... 297/344.18 |
| 6,126,236 | A | * | 10/2000 | Wu ..... 297/325 |
| 6,161,898 | A | | 12/2000 | Brevi |
| 6,179,376 | B1 | * | 1/2001 | Meeker et al. ..... 297/137 |
| 6,299,247 | B1 | | 10/2001 | Meeker et al. |
| 6,478,113 | B1 | * | 11/2002 | Ellison ..... 182/204 |
| 6,500,072 | B1 | | 12/2002 | Myers et al. |
| 6,698,550 | B2 | * | 3/2004 | Crain ..... 182/166 |

FOREIGN PATENT DOCUMENTS

| | | |
|---|---|---|
| CA | 858288 | 12/1970 |
| FR | 1345571 | 11/1963 |

* cited by examiner

*Primary Examiner*—Peter M. Cuomo
*Assistant Examiner*—Erika Garrett
(74) *Attorney, Agent, or Firm*—Cooley Godward LLP

(57) ABSTRACT

An infant support structure having a frame, a support, and a height adjustment mechanism. The frame includes telescoping legs that support the frame in selected positions above the support surface.

24 Claims, 11 Drawing Sheets

HEIGHT ADJUSTMENT MECHANISM FOR AN INFANT SUPPORT STRUCTURE

BACKGROUND OF THE INVENTION

This invention relates generally to a height adjustment mechanism for an infant support structure, and more particularly, to a height adjustment mechanism for a high chair.

Some conventional support structures have a seat that can be adjusted relative to a support surface. Such support structures are typically complex and difficult to use. Many support structures, such as high chairs, typically do not include a seat that can be adjusted, and thereby cannot be used in different scenarios.

A need exists for a support structure with a seat that can be adjusted relative to a support surface to better position a child for feeding and other activities. A need also exists for a support structure that has a height adjustment mechanism that is easy to use.

SUMMARY OF THE INVENTION

An infant support structure includes a height adjustment mechanism. In one embodiment, the infant support structure is a high chair. In other embodiments, the infant support structure is any support structure that can support an infant.

In one embodiment, the infant support structure includes a frame and a seat or support that is mounted to the frame. The frame includes several legs that can be adjusted to vary the height of the seat relative to a support surface. In one embodiment, the infant support structure includes front and rear height adjustment mechanisms. In one embodiment, each height adjustment mechanism includes a movable member that selectively engages the frame of the infant support structure to retain the seat at a particular height. The height adjustment mechanism includes an actuator that can manipulated to engage and move the movable member.

DETAILED DESCRIPTION OF THE INVENTION

An infant support structure includes a height adjustment mechanism. In one embodiment, the infant support structure is a high chair. In other embodiments, the infant support structure is any support structure that can support an infant.

In one embodiment, the infant support structure includes a frame and a seat or support that is mounted to the frame. The frame includes several legs that can be adjusted to vary the height of the seat relative to a support surface. In one embodiment, the infant support structure includes front and rear height adjustment mechanisms. In one embodiment, each height adjustment mechanism includes a movable member that selectively engages the frame of the infant support structure to retain the seat at a particular height. The height adjustment mechanism includes an actuator that can be manipulated to engage and move the movable member.

Figure 1:
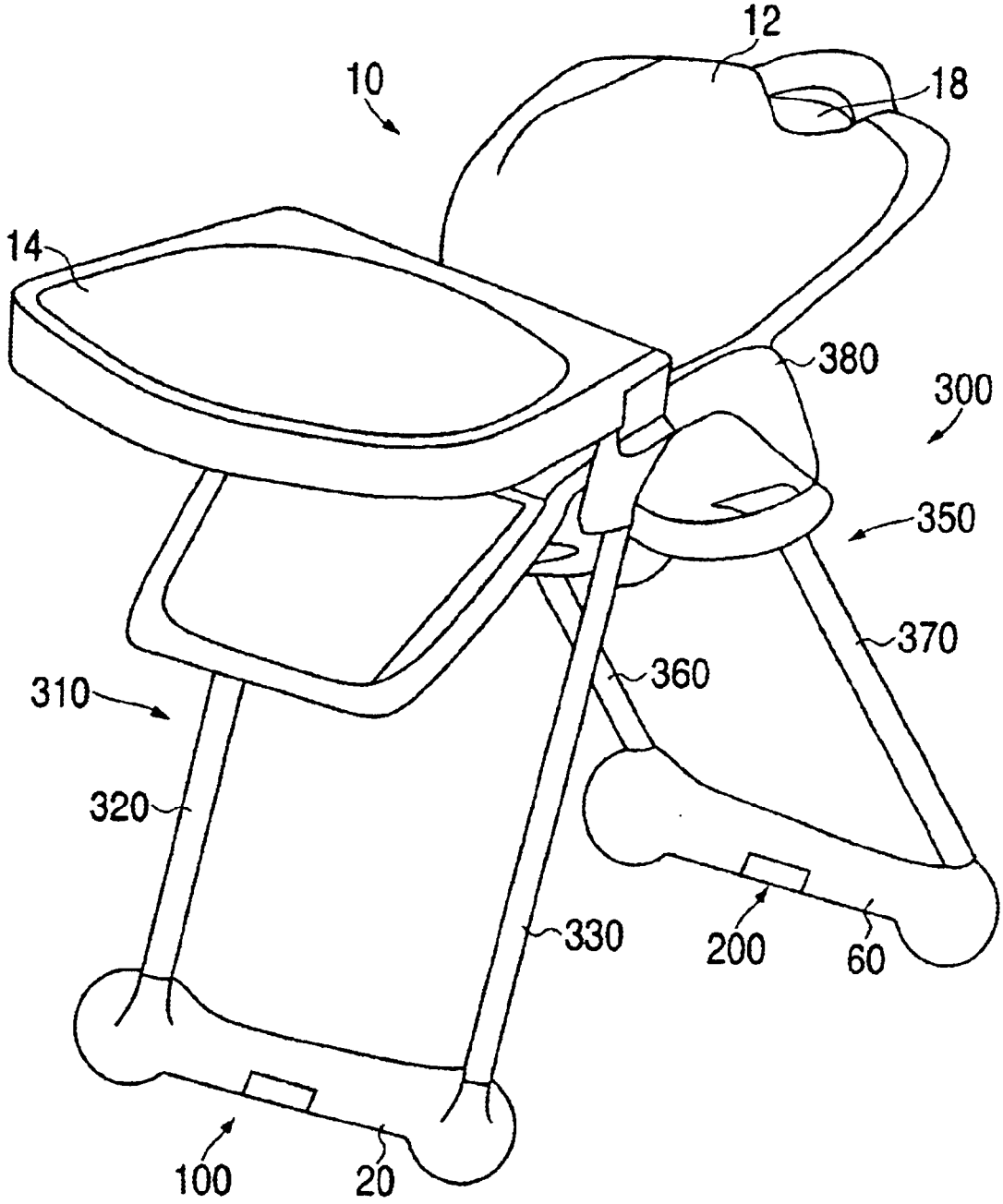
FIG. 1 is a front perspective view of an embodiment of an infant support structure according to the invention.
Figure 2:
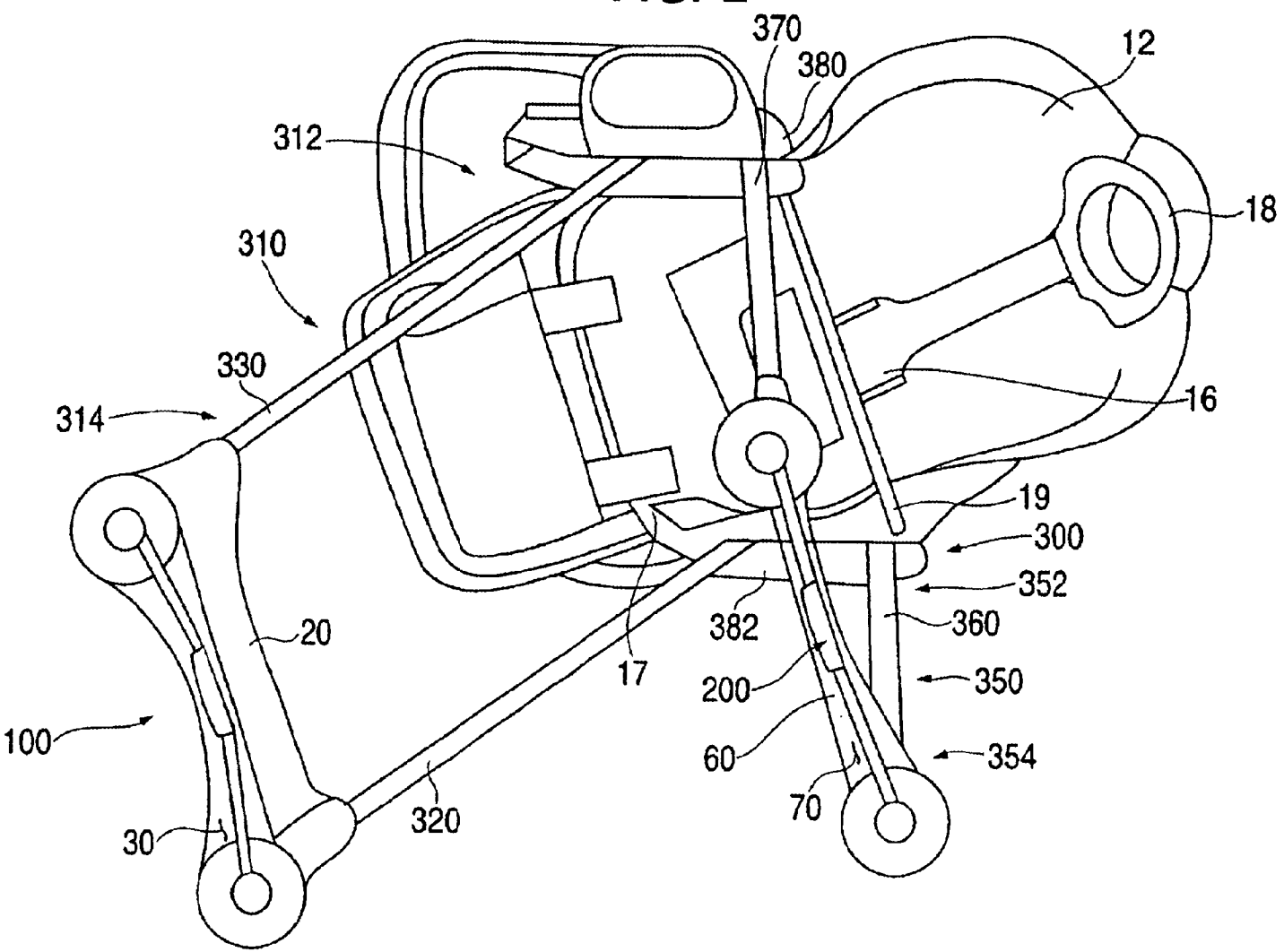
FIG. 2 is a bottom perspective view of the infant support structure of FIG. 1.

A perspective view of an embodiment of a support structure according to the present invention is illustrated in FIGS. 1 and 2. In the illustrated embodiment, the support structure 10 is a high chair for an infant or a child. In alternative embodiments, the support structure may be any other structure that can support a child or infant, such as a swing, a stroller, etc. The support structure can be referred to alternatively as a child support structure or an infant support structure.

Support structure 10 includes a seat or support 12 that is coupled to a frame 300. In one embodiment, the seat 12 includes a seat portion and a back portion that are integrally formed. The seat 12 is pivotally coupled to a mounting bar 17 that is coupled to the frame 300 (see FIG. 2).

In the illustrated embodiment, the frame 300 includes a front frame portion 310 and a rear frame portion 350. The front frame portion 310 includes an upper end 312 and a lower end 314. The rear frame portion 350 includes an upper end 352 and a lower end 354. The upper ends 312 and 352 of the front frame portion 310 and the rear frame portion 350 are coupled to housings 380 and 382 that located on opposite sides of the frame 300 (see FIG. 2). In one embodiment, the seat 12 is coupled proximate to the upper ends 312 and 352 of the frame portions 310 and 350.

The front frame portion 310 includes legs 320 and 330. The front frame portion 310 also includes abase 20 at the lower end 314 of the front frame portion 310. The lower ends of the legs 320 and 330 are coupled to the base 20. The rear frame portion 350 includes legs 360 and 370. The rear frame portion 350 also includes a base 60 at the lower end 354 of the rear frame portion 350. The lower ends of the legs 360 and 370 are coupled to the base 60.

In the illustrated embodiment, the support structure 10 includes a first or front height adjustment mechanism 100 and a second or rear height adjustment mechanism 200. In alternative embodiments, the support structure can include a single height adjustment mechanism.

Height adjustment mechanism 100 is configured to adjust the length of legs 320 and 330 relative to the base 20. Similarly, height adjustment mechanism 200 is configured to adjust the length of legs 360 and 370 relative to the base 60. By adjusting the lengths of legs 320, 330, 360, and 370, the lengths of the front frame portion 310 and rear frame portion 350 change, thereby varying the height of the seat 12 relative to the bases 20 and 60 and to the support surface on which the support structure 10 is placed.

The support structure 10 also includes a tray 14 and a seat recline mechanism 16 that is operable via handle 18 (see FIG. 2). The handle 18 is slidably mounted along the back surface of the seat 12 and is biased by a spring (not shown) in a generally downward direction. A bar 19 is coupled to a lower end of the handle 18. The bar 19 engages a series of notches formed on the inner surface of each of the housings 380 and 382.

The angle of inclination of the seat 12 can be adjusted relative to the frame 300 by pulling upwardly on the handle 18 to disengage the bar 19 from notches, pivoting the seat 12 about bar 17 to the desired inclination position, and releasing the handle 18 so that the bar 19 engages the desired notches on the housings 380 and 382.

Referring to FIG. 2, base 20 includes a cavity 30 and base 60 includes a cavity 70. In the illustrated embodiment, height adjustment mechanism 100 is disposed in the cavity 30 of base 20. Similarly, height adjustment mechanism 200 is disposed in the cavity 70 of base 60.

Figure 3:
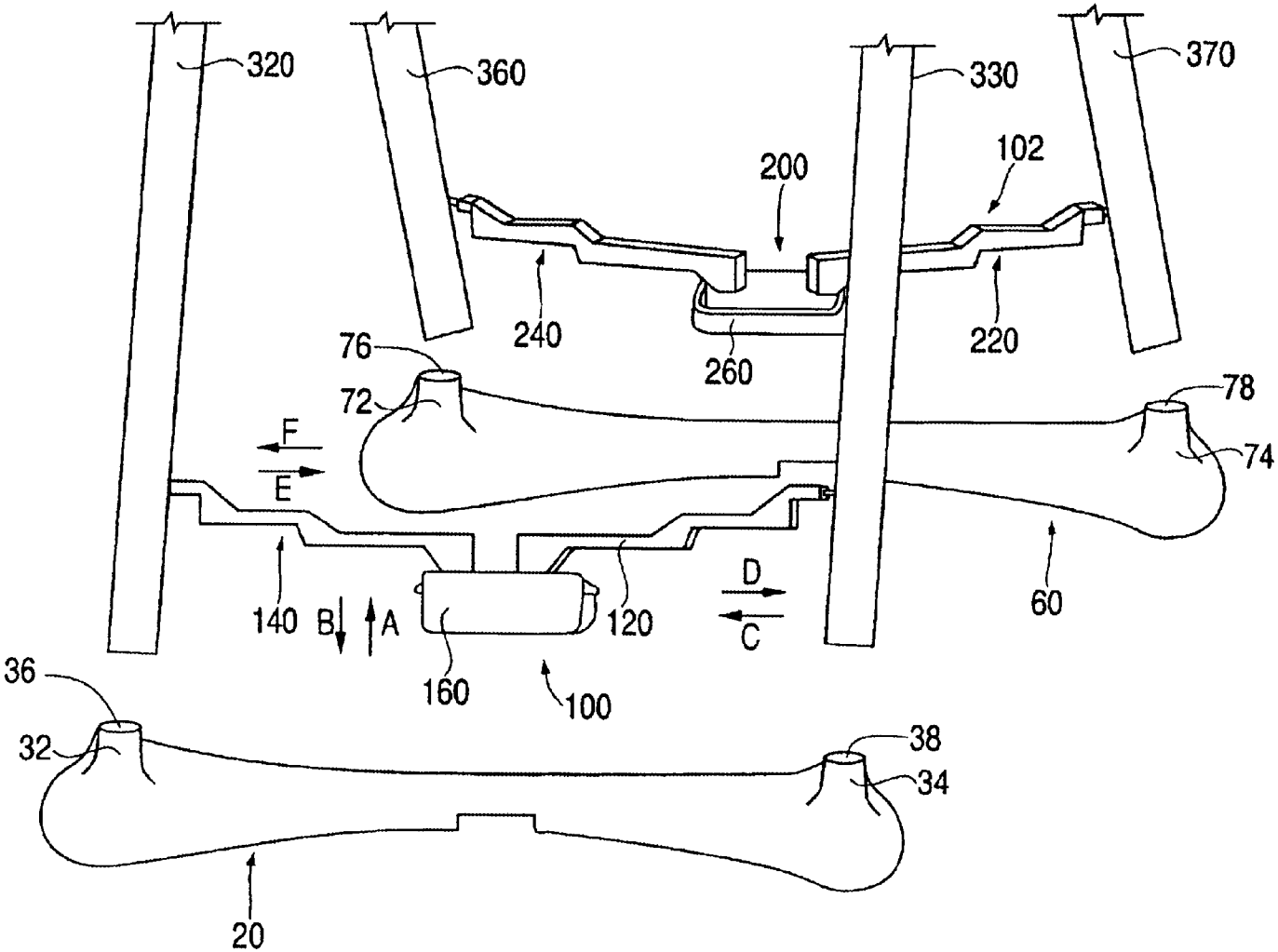
FIG. 3 is an exploded perspective view of the bases and height adjustment mechanisms of the infant support structure of FIG. 1.

Several components of an embodiment of the support structure are illustrated in FIG. 3. Base 20 has receiving portions 32 and 34 located proximate to opposite ends of the base 20. Receiving portion 32 includes an opening 36 that is configured to receive a lower end of leg 320. Receiving portion 34 includes an opening 38 that is configured to receive a lower end of leg 330.

Base 60 has receiving portions 72 and 74 located proximate to opposite ends of the base 60. Receiving portion 72 includes an opening 76 that is configured to receive a lower end of leg 360. Receiving portion 74 includes an opening 78 that is configured to receive a lower end of leg 370.

In the illustrated embodiment, the lower end of leg 320 is inserted into opening 36 and leg 320 is coupled to the base 20. Leg 330 is inserted into opening 38 and coupled to base 20. Similarly, legs 360 and 370 are inserted into openings 76 and 78, respectively, and coupled to base 60.

As illustrated in FIG. 3, height adjustment mechanism 100 includes a first movable member or lock 120, a second movable member or lock 140, and a third movable member or actuator 160. Actuator 160 is operatively engaged with the locks 120 and 140. As described in greater detail below, movement of the actuator 160 causes movement of the locks 120 and 140 relative to legs 320 and 330 of the frame 300. The locks can be referred to collectively as a coupling mechanism or individually as elongate members, coupling members, and engaging members.

In one embodiment, movement of the actuator 160 along the direction of arrow "A" causes lock 120 to move inwardly along the direction of arrow "C" and lock 140 to move inwardly along the direction of arrow "E." As lock 120 moves along the direction of arrow "C," the lock 120 disengages from leg 330. Similarly, as lock 140 moves along the direction of arrow "E," the lock 140 disengages from leg 320.

As described in more detail below, the locks 120 and 140 are biased outwardly into engagement with legs 330 and 320, respectively. In particular, lock 120 is biased along the direction of arrow "D" and lock 140 is biased along the direction of arrow "F." Movement of actuator 160 along the direction of arrow "B" enables lock 120 to move outwardly along the direction of arrow "D" and lock 140 to move outwardly along the direction of arrow "F."

Height adjustment mechanism 200 includes a first movable member or lock 220, a second movable member or lock 240, and a third movable member or actuator 260. Actuator 260 and locks 220 and 240 function in the same manner and move generally along the same directions as actuator 160 and locks 120 and 140, respectively.

As previously described, in the illustrated embodiment, each height adjustment mechanism includes a pair of movable members or locks that are moved substantially simultaneously. In an alternative embodiment, each height adjustment mechanism can include a pair of movable members or locks that are independently actuated. In such an embodiment, each movable member of the support structure can be independently actuated.

Figure 4:
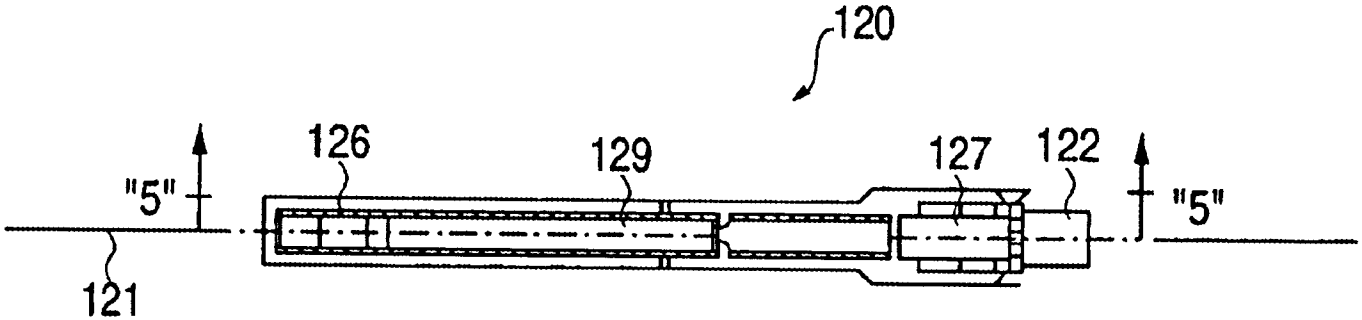
FIG. 4 is a top view of an embodiment of a lock according to the invention.
Figure 5:
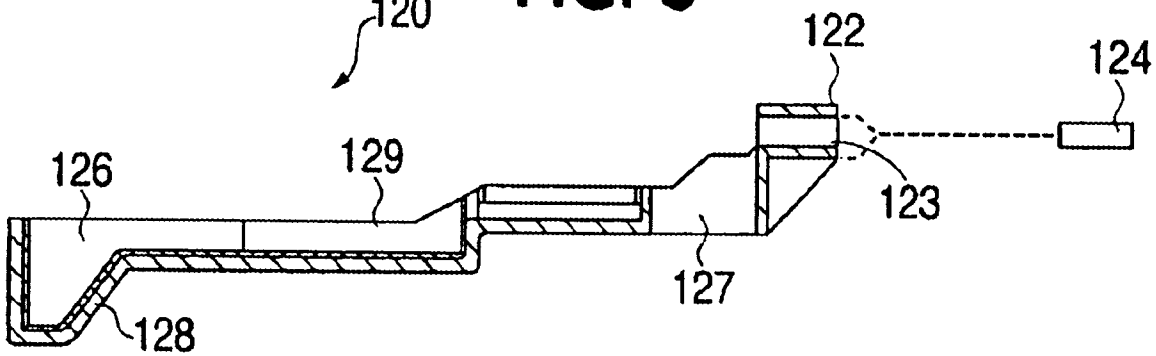
FIG. 5 is a cross-sectional side view of the lock of FIG. 4 taken along the line 5—5.

An embodiment of a movable member or lock according to the present invention is illustrated in FIGS. 4 and 5. In this embodiment, the lock 120 includes a first end 122, a second end 126, and a longitudinal axis 121 extending between the ends 122 and 126. The lock 120 includes an opening 123 into which a protrusion or extension 124 can be inserted. The protrusion 124 is the portion of the lock 120 that engages leg 330. While protrusion 124 is illustrated as being separate from the lock 120, the protrusion can be integrally formed with the lock in alternative embodiments.

The lock 120 includes a lower surface that has a tapered portion or cam surface 128. The lock 120 also includes a cavity 129 and a through opening 127. In the illustrated embodiment, the other movable members or locks have substantially similar structures.

Figure 6:
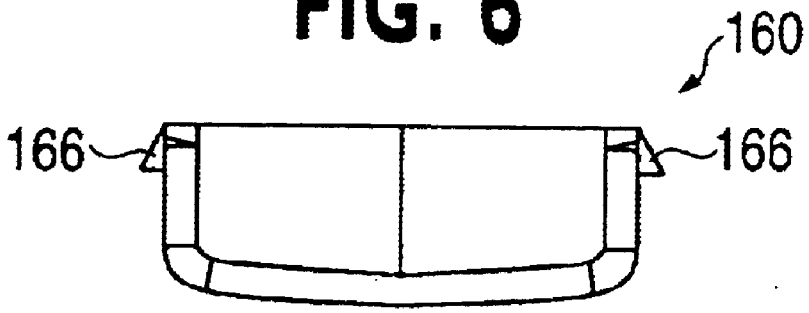
FIG. 6 is a rear view of an embodiment of an actuator according to the invention.
Figure 7:
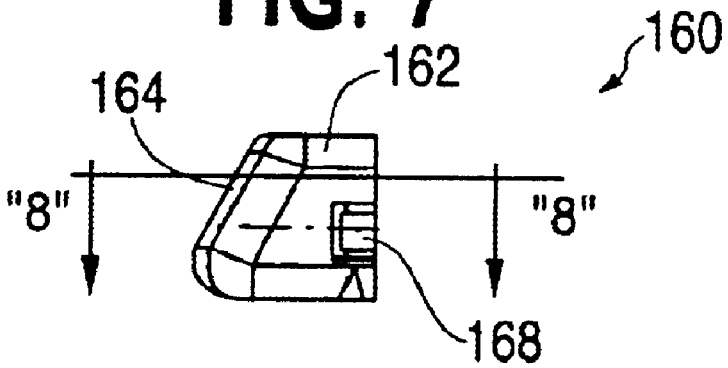
FIG. 7 is a side view of the actuator of FIG. 6.
Figure 8:
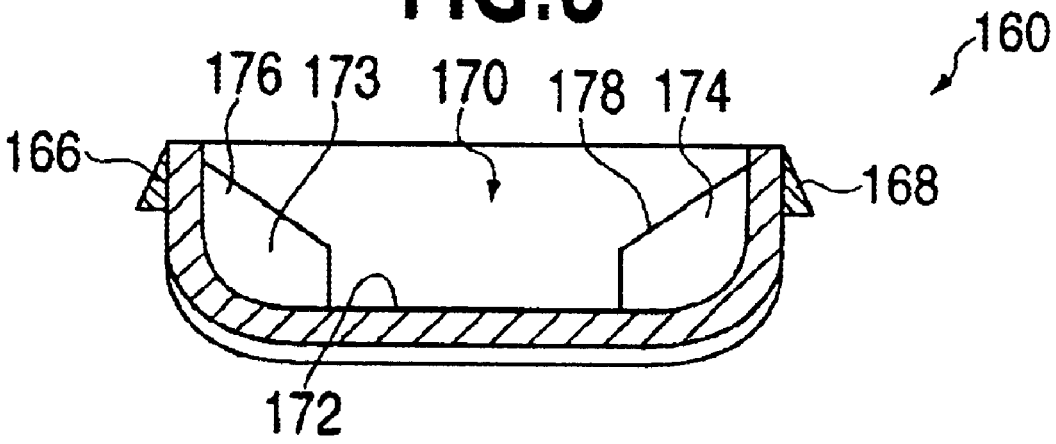
FIG. 8 is a cross-sectional front view of the actuator of FIG. 7 taken along the line 8—8.
Figure 12:
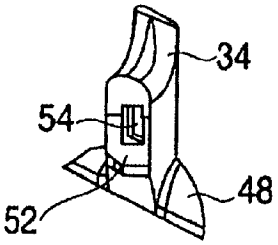
FIG. 12 is a cross-sectional side view of the base of FIG. 11 taken along the line 12—12.
Figure 13:
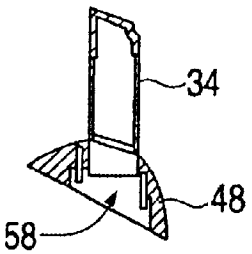
FIG. 13 is a cross-sectional side view of the base of FIG. 11 taken along the line 13—13.
Figure 9:
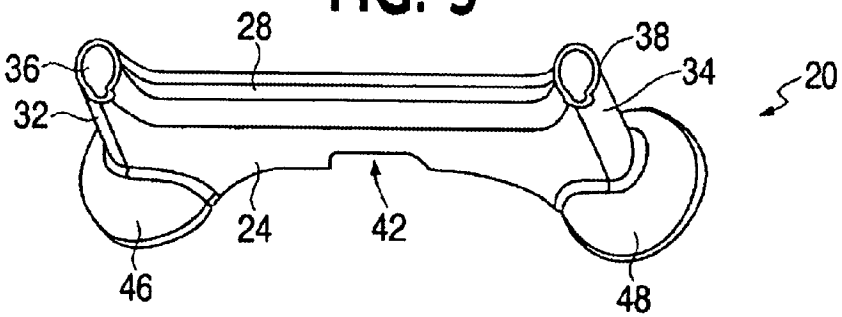
FIG. 9 is a top perspective view of an embodiment of a base according to the invention.

An embodiment of an actuator according to the present invention is illustrated in FIGS. 6–8. In this embodiment, the actuator 160 includes a side wall 162 and an engaging surface or wall 164. During operation, a user can press on the engaging surface 164 to move the actuator 160.

The actuator 160 includes tabs 166 and 168 that extend outwardly from opposite ends of the actuator 160. Tabs 166 and 168 are used to couple the actuator 160 to base 20 as discussed in detail later.

As illustrated in FIG. 8, the side wall 162 and engaging wall 164 form an inner surface 172 that defines a cavity 170. Actuator 160 includes cam members or plates 173 and 174 that are coupled to the inner surface 172 of the actuator 160. Cam member 173 includes a cam surface 176. Similarly, cam member 174 includes a cam surface 178. During operation, the cam surface 176 of cam member 173 engages the tapered surface 148 of lock 140. Similarly, the cam surface 178 of cam member 174 engages the tapered surface 128 of lock 120.

In one embodiment, the angles of inclination of cam surfaces 176 and 178 are substantially the same as the angles of inclination of the tapered surfaces 128 and 148 of the locks 120 and 140. In alternative embodiments, the cam surfaces 176 and 178 and the tapered surfaces 128 and 148 can have any shape or configuration that enables the corresponding surfaces to move relative to each other when the actuator 160 is pressed.

An embodiment of a base according to the present invention is illustrated in FIGS. 9–13. Base 20 includes a lower surface 22, a front surface 24, a rear surface 26, and a upper surface 28. Base 20 includes end portions 46 and 48 located proximate to the ends of the base 20. As illustrated, receiving portion 32 is located proximate to end portion 46 and receiving portion 34 is located proximate to end portion 48.

Figure 10:
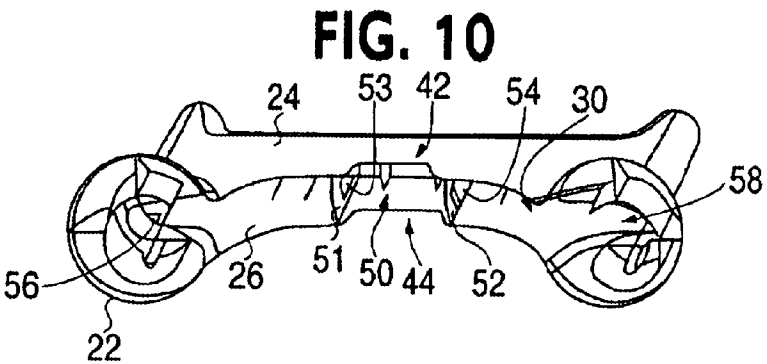
FIG. 10 is a bottom perspective view of the base of FIG. 9.
Figure 11:
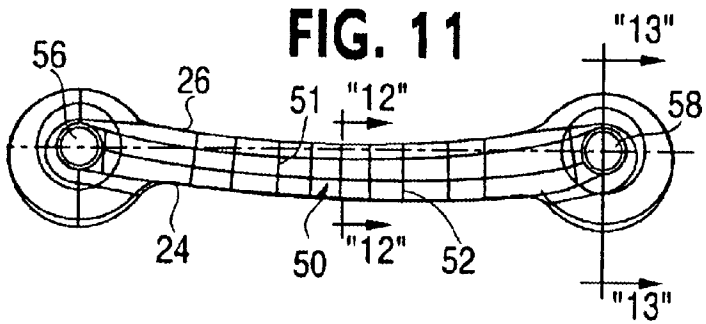
FIG. 11 is a bottom view of the base of FIG. 9.

As illustrated in FIG. 10, the front surface 24 of the base 20 includes a recess 42 and the rear surface 26 of the base 20 includes a recess 44 that is aligned with recess 42. Recesses 42 and 44 are configured to enable a user to engage the actuator 160 of the height adjustment mechanism 100 located in the base 20 from either side of the base 20. In alternative embodiments, it is not necessary that recesses 42 and 44 have the same size or configuration.

The base 20 includes plates 51 and 52 located in cavity 30. The plates 51 and 52, front wall 24 and rear wall 26 collectively define a central cavity portion 50 therebetween. In the illustrated embodiment, the central cavity portion 50 is configured to receive the actuator 160 of height adjustment mechanism 100.

The actuator 160 is pressed into the central cavity portion 50 so that the tabs 166 and 168 engage openings 53 and 54 in the plates 51 and 52 to couple the actuator 160 to the base 20. The openings 53 and 54 are configured so that the actuator 160 can move or slide in the central cavity portion 50. Opening 53 is also configured to slidably receive a portion of lock 140 therethrough. Similarly, opening 54 is configured to slidably receive a portion of lock 120 therethrough.

End portion 46 includes an internal mounting recess 56. Mounting recess 56 is configured to receive a cap that is coupled to the lower end of the leg 320 that is inserted into receiving portion 32. Similarly, end portion 48 includes an internal mounting recess 58. Mounting recess 58 is configured to receive a cap that coupled to the lower end of the leg 330 that is inserted into receiving portion 34.

Figure 16:
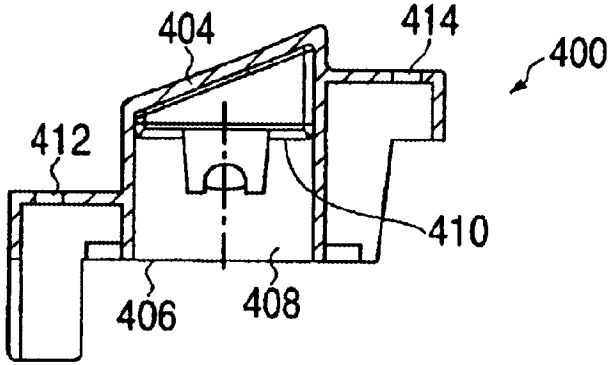
FIG. 16 is a cross-sectional side view of the cap of FIG. 5 taken along the line 16—16.
Figure 15:
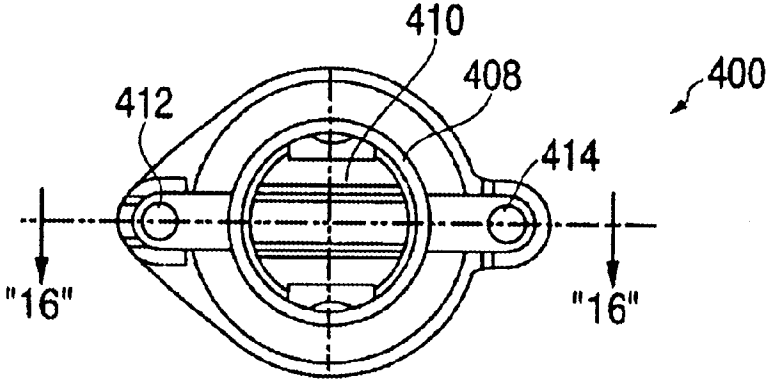
FIG. 15 is a top view of the cap of FIG. 14.
Figure 14:
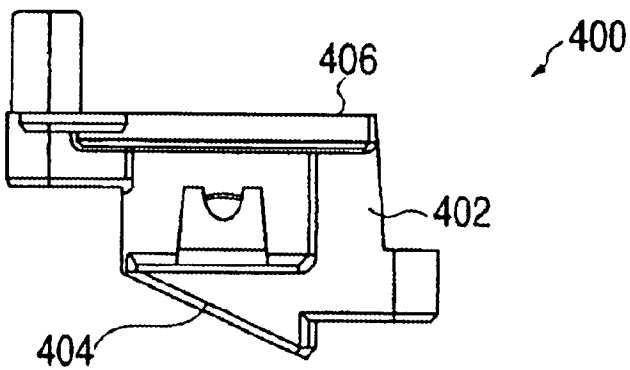
FIG. 14 is a side view of an embodiment of a cap according to the invention.

An embodiment of a cap according to the present invention is illustrated in FIGS. 14–16. In this embodiment, cap 400 includes a body 402 with a lower surface 404 and an upper surface 406. Cap 400 also includes a sleeve 408 that defines an opening into which the lower end of a leg is inserted. The sleeve 408 includes a lower surface 410 that functions as a stop surface that limits the insertion of the leg. Each leg is snapped into a corresponding cap. In one embodiment, each cap is coupled to the lower end of a leg via a conventional connector, such as a screw or rivet. The caps are discussed in detail with respect to FIG. 17.

The body 402 of the cap 400 also includes mounting openings 412 and 414. The cap 400 is coupled to the lower end of the base 20 via conventional fasteners that are inserted through openings 412 and 414.

Lower surface 404 is disposed at an angle with respect to the body 402. As illustrated in FIG. 1, legs 320, 330, 360, and 370 are oriented so that the lower surface of each leg is disposed at an angle with respect to a support surface. When the support structure is assembled, angled lower surface 404 extends below the lower surface 22 of the base 20 and engages the support surface.

In the illustrated embodiment, the lower surface 404 is configured to have an angle that is complimentary to the angle between a longitudinal axis of a support structure leg and the lower surface of a base and the support surface. The lower surface of the cap is configured to provide an engagement surface that engages the support surface on which the support structure is placed. For example, in one implementation, if the legs are configured so that a longitudinal axis of each leg extends upwardly at an angle of approximately 80° with respect to the support surface, the angled lower surface of the cap is configured to be approximately 10° with respect to the body of the cap.

In an alternative embodiment, each cap can be integrally formed with a corresponding base. In another embodiment, some of the caps can be integrally formed with a base and other caps can be formed separately from and coupled to a base.

Now the operation of a height adjustment mechanism is described with reference to FIGS. 17 and 18. While in one embodiment the support structure includes height adjustment mechanisms 100 and 200, only height adjustment mechanism 100 is discussed in detail to simplify the discussion. Also, the base 20 is not illustrated in FIG. 17 to simplify the illustration.

In this embodiment, leg 320 includes an upper portion 328 and a lower portion 329. Leg 330 includes an upper portion 338 and a lower portion 339. In one embodiment, the portions of legs 320 and 330 are hollow tubular elements.

The lower end of lower portion 329 of leg 320 is fixedly coupled to the base 20. The upper portion 328 of leg 320 is slidably mounted on lower portion 329. The lower end of lower portion 339 of leg 330 is also fixedly coupled to the base 20. The upper portion 338 of leg 330 is slidably mounted on lower portion 339.

The upper portion 328 of leg 320 includes several openings or apertures 322, 324, and 326. The upper portion 338 of leg 330 includes several openings 332, 334, and 336. While the upper portions 328 and 338 are illustrated with three openings, any number of openings may be provided on the legs 320 and 330.

The lower portions 329 and 339 of legs 320 and 330 include an opening that is aligned to receive the protrusions 144 and 124, respectively. When a particular opening on an upper portion is aligned with the opening on a lower portion, a protrusion can be inserted into the aligned openings to coupled the upper and lower portions together.

Figure 17:
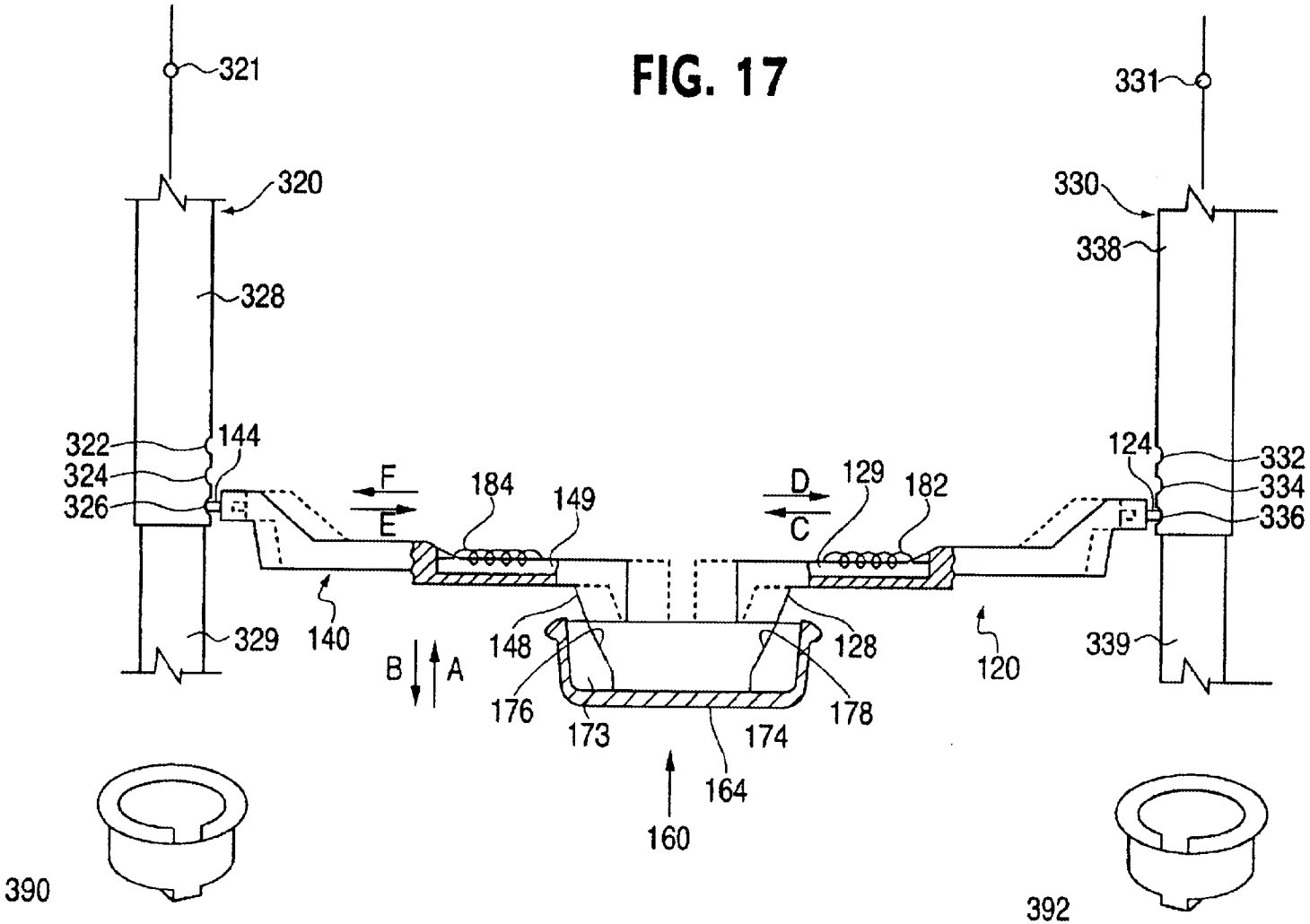
FIG. 17 is a front partial cross-sectional view of the height adjustment mechanism and legs of the infant support structure of FIG. 1.

In FIG. 17, locks 120 and 140 are illustrated in their engaging positions. In these positions, the locks 120 and 140 engage legs 330 and 320, respectively. In one configuration, the protrusion 144 of lock 140 engages opening 326 of leg 320 and the protrusion 124 of lock 120 engages opening 336 of leg 330.

Lock 140 is slidably mounted in the base 20. In the illustrated embodiment, lock 140 extends through opening 53 in plate 51 on the base 20. End 146 of the lock 140 is retained in the central cavity portion 150 of the base 20 where it is engaged by the actuator 160. A fastener (not shown) is mounted through the opening 147 in the lock 140 to slidably couple the lock 140 to the base 20. The range of motion of the lock 140 is determined by the length of the opening 147.

Similarly, lock 120 is slidably mounted in the base 20. Lock 120 extends through opening 54 in plate 52 on the base 20. End 126 of the lock 120 is retained in the central cavity portion 150 of the base 20 where it is engaged by the actuator 160. A fastener (not shown) is mounted through the opening 127 in the lock 120 to slidably couple the lock 120 to the base 20. The range of motion of the lock 120 is determined by the length of the opening 127.

As illustrated in FIG. 17, a biasing element 182, such as a spring, is disposed in the cavity 129 of lock 120. One end of the biasing element 182 engages an inner surface of the cavity 129. The other end of the biasing element 182 engages a surface in the cavity 30 in the base 20. In one embodiment, the biasing element 182 engages a rib in the cavity 30. The biasing element 182 biases the lock 120 along the direction of arrow "D" into engagement with the leg 330.

When the lock 120 is biased into engagement with the leg 330, the protrusion 124 engages the particular opening 332, 334, or 336 with which it is aligned. When the protrusion 124 engages an opening, the protrusion 124 engages the lower portion 339 and the upper portion 338 of the leg 330 and prevents the portions 338 and 339 from moving relative to each other.

A biasing element 184, such as a spring, is disposed in the cavity 149 of lock 140. One end of the biasing element 184 engages an inner surface of the cavity 149. The other end of the biasing element 184 engages a surface in the cavity 70 in the base 60. In one embodiment, the biasing element 184 engages a rib in the cavity 70. The biasing element 184 biases the lock 140 along the direction of arrow "F" into engagement with the leg 320.

When the lock 140 is biased into engagement with the leg 320, the protrusion 144 engages the particular opening 322, 324, or 326 with which it is aligned. When the protrusion 144 engages an opening, the protrusion 144 engages the lower portion 329 and the upper portion 328 of the leg 320 and prevents the portions 328 and 329 from moving relative to each other.

When the actuator 160 is moved upwardly along the direction of arrow "A," the cam surfaces 178 and 176 engage the tapered surfaces 128 and 148 of locks 120 and 140, respectively, and locks 120 and 140 are moved into their retracted positions (illustrated in dashed lines in FIG. 17).

As the cam surface 176 engages the tapered surface 148, the lock 140 moves inwardly along the direction of arrow "E." If the lock 140 moves a sufficient distance, the protrusion 144 disengages from the leg 320 and the upper portion 328 can slide relative to the lower portion 329. As the cam surface 178 engages the tapered surface 128, the lock 120 moves inwardly along the direction of arrow "C." If the lock 120 moves a sufficient distance, the protrusion 124 disengages from leg 330 and the upper portion 338 can slide relative to the lower portion 339.

When the actuator 160 is released, the biasing elements 182 and 184 bias the locks 120 and 140 along the directions of arrows "D" and "F," respectively, into their extended positions as illustrated in FIG. 17. As the locks 120 and 140 move in those directions, the tapered surfaces 128 and 148 engage the cam surfaces 178 and 176 and force the actuator 160 along the direction of arrow "B." The locks 120 and 140 are then located in their extended positions.

In the illustrated embodiment, lock 140 moves along a direction that is substantially perpendicular to the longitudinal axis 321 of leg 320. Similarly, lock 120 moves along a direction that is substantially perpendicular to the longitudinal axis 331 of leg 330. Actuator 160 is mounted for movement along a direction that is substantially parallel to the longitudinal axes 321 and 331 of the legs 320 and 330.

In alternative embodiments, the particular directions of movement of the locks and the actuator may vary respect to the legs 320 and 330 of the support structure 10. The locks and the actuator can be mounted in any configuration or arrangement that enables them to move relative to and selectively engage the legs of the support structure.

In the illustrated embodiment, the lower leg portion 329 is snapped into cap 390 which retains the lower leg portion 329 to the base. Similarly, lower leg portion 339 is snapped into cap 392 which retains the lower leg portion 339 to the base. Each of the legs 360 and 370 includes a lower leg portion (not shown) that is coupled to the rear base via respective caps.

In one embodiment, a single biasing element can be located between the locks to bias the locks into their engagement positions.

In another embodiment, an actuator is configured to be pushed downwardly to move one or more locks inwardly and to be pulled upwardly to allow the lock to move outwardly to engage part of a support structure.

Figure 18:
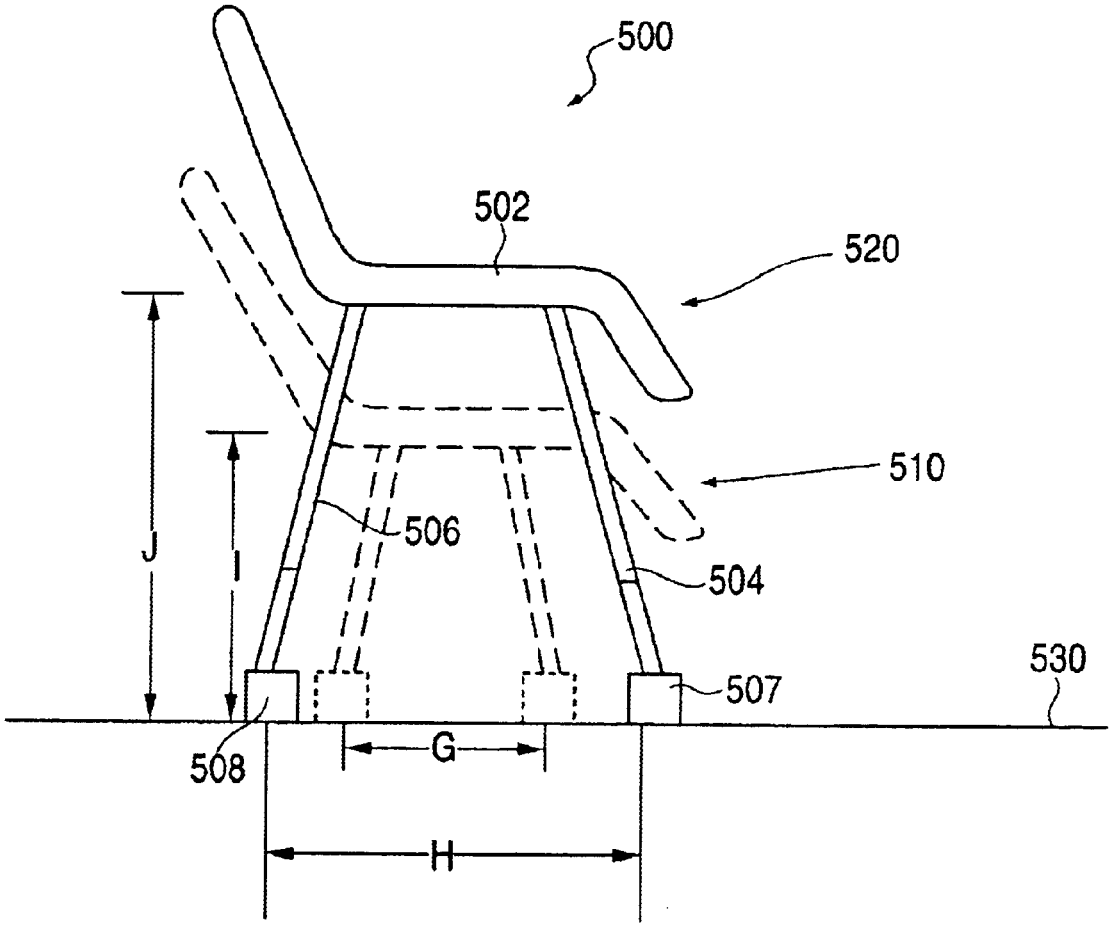
FIG. 18 is a side view of an infant support structure in multiple configurations.

An embodiment of a support structure that can be disposed in several configurations is illustrated in FIG. 18. In this embodiment, the support structure 500 includes a seat portion 502, a front frame portion 504, and a rear frame portion 506. The support structure 500 also includes bases 507 and 508 to which the front frame portion 504 and the rear frame portion 506 are coupled, respectively.

The support structure 500 includes height adjustment mechanisms (not shown) that facilitate the adjustment of the lengths of the legs 504 and 506. In particular, a user can adjust the length of the legs 504 and 506 via one or more of the height adjustment mechanisms. The lengths of the legs 504 and 506 can be adjusted to dispose the support structure 500 in multiple configurations and to adjust the height of the seat portion 502 relative to a support surface 530 and to the bases 507 and 508.

The support structure 500 can be disposed in several configurations relative to the bases 507 and 508. In one embodiment, the support structure 500 can be disposed in a first or lowered configuration 510 and a second or raised configuration 520. In the first configuration 510, illustrated in dashed lines, the lower ends of the legs 504 and 506 are spaced apart a distance "G." In this configuration, the height of the seat portion 502 is represented by "I."

The support structure 500 can be disposed in its second configuration 520 by lengthening the legs 504 and 506 as compared to the first configuration 510. In configuration 520, the lower ends of the legs 504 and 506 are spaced apart a distance "H" and the height of the seat portion 502 is represented by "J." As illustrated in FIG. 18, distances "H" and "J" are greater than the distances "G" and "I," respectively.

Figure 19:
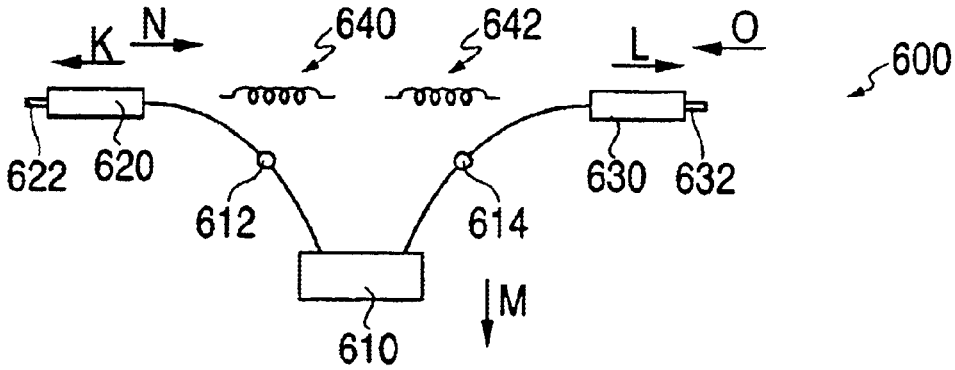
FIG. 19 is a schematic view of an alternative embodiment of a locking mechanism according to the invention.

An alternative embodiment of a locking mechanism according to the invention is illustrated in FIG. 19. The locking mechanism 600 is formed as a unitary member that can be activated and that can lock one or more legs of a support structure in place. The locking mechanism 600 includes an actuator portion 610, an engaging portion 620, and an engaging portion 630. In this embodiment, the actuator portion 610 and the engaging portions 620 and 630 are integrally molded. In an alternative embodiment, the actuator portion 610 and the engaging portions 620 and 630 can be formed separately and coupled together.

The actuator portion 610 includes couplers 612 and 614 that couple the engaging portions 620 and 630 and the actuator portion 610. Couplers 612 and 614 can be made of a springy, flexible material that has a sufficient strength to impart movement to the engaging portions 620 and 630.

Engaging portion 620 includes a projection 622 that is configured to engage a hole or holes in a leg of a support structure. Similarly, engaging portion 630 includes a projection 632 that is configured to engage a hole or holes in another leg of a support structure. In one embodiment, the projections 622 and 632 are made of metal, such as steel. In other embodiments, any material that has a sufficient stiffness can be used for the projections.

In one embodiment, biasing elements 640 and 642, such as springs, are used to bias the engaging portions 620 and 630 outwardly along the directions of arrows "K" and "L," respectively, to their extended or locked positions. In another embodiment, a single biasing element can be used instead of biasing elements 640 and 642.

As a user moves the actuator portion 610 along the direction of the arrow "M," the engaging portions 620 and 630 move inwardly along the directions of arrows "N" and "O," respectively, to their retracted or unlocked positions. When the user releases the actuator portion 610, the biasing elements 640 and 642 force the engaging portions 620 and 630 outwardly along the directions of arrows "K" and "L."

Figure 20:
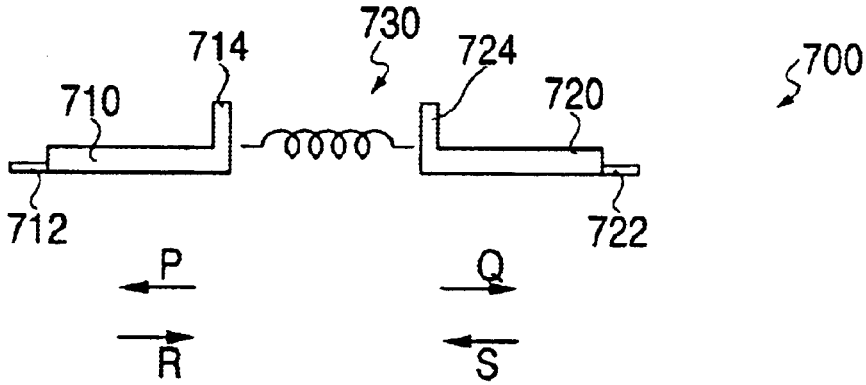
FIG. 20 is a schematic view of an alternative embodiment of a locking mechanism according to the invention.

An alternative embodiment of a locking mechanism according to the invention is illustrated in FIG. 20. In this embodiment, the locking mechanism 700 includes locks 710 and 720 that are mounted for movement relative to a support structure. Lock 710 includes a projection 712 that is configured to engage one or more holes on a leg of a support structure. Similarly, lock 720 includes a projection 722 that is configured to engage one or more holes of a leg of a support structure.

In this embodiment, the locking mechanism 700 does not include a separate actuator portion or member. Lock 710 includes a cam surface 714 that extends at an angle with respect to the remainder of the lock 710. Similarly, lock 720 includes a cam surface 724 that extends at an angle with respect to the remainder of the lock 720. The cam surfaces 714 and 724 can extend in any direction, such as upwardly, downwardly, or sideways, from the locks 710 and 720, respectively. In alternative embodiments, the locks 710 and 720 can have any shape or configuration.

The locking mechanism 700 includes a biasing element 730, such as a spring, that is disposed between the locks 710 and 720 to bias the locks 710 and 720 to their extended or locked positions along the directions of arrows "P" and "Q," respectively. In an alternative embodiment, separate biasing elements can be used to bias the locks.

When a user wants to release lock 710, the user engages cam surface 714 and moves it along the direction of arrow "R." Similarly, when a user wants to release lock 720, the user engages cam surface 724 and moves it along the direction of arrow "S." Cam surfaces 714 and 724 can be engaged simultaneously to move the locks 710 and 720 at the same time.

Figure 21:
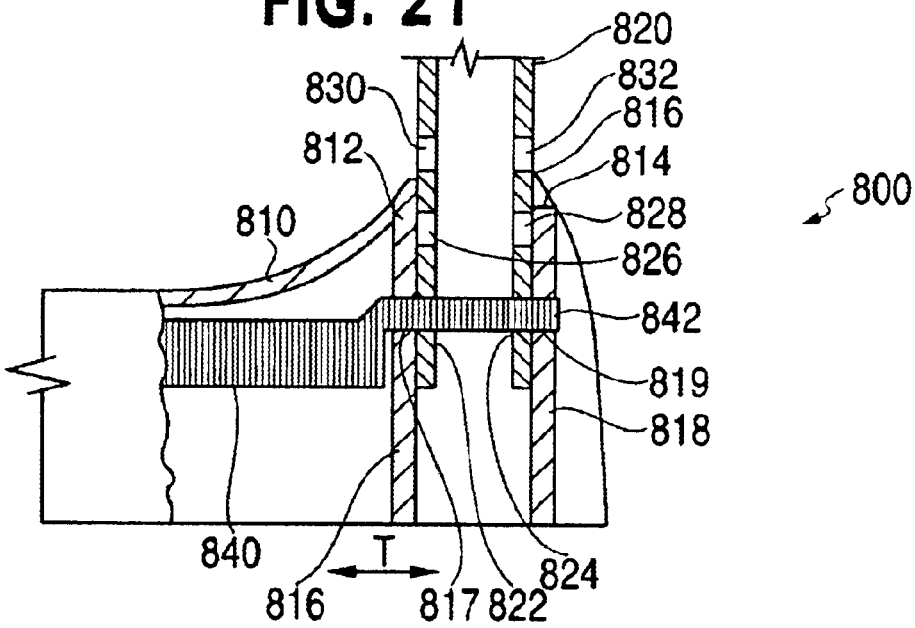
FIG. 21 is a cross-sectional front view of an alternative embodiment of some components of a support structure according to the invention.

An alternative embodiment of several components of a support structure according to the invention is illustrated in FIG. 21. In this embodiment, the support structure 800 includes a base 810 that has a mounting portion 812. The mounting portion 812 includes a substantially cylindrical sleeve 814 that is configured to receive a portion of a leg 820 of the support structure. The sleeve 814 is integrally molded with the base 810. The sleeve 814 extends to the lower surface of the base 810 and contacts a support surface on which the base 810 is located. The sleeve 814 also includes a first portion 816 and a second portion 818 that collectively define the sleeve 814. Portions 816 and 818 include aligned openings 817 and 819, respectively.

A leg 820 can be inserted into the opening defined by the sleeve 814. The leg 820 includes openings 822 and 824 that are aligned in opposite sides of the leg 820. As illustrated, the leg 820 includes several pairs of aligned openings, such as openings 826 and 828 and openings 830 and 832. The various pairs of openings enable the leg 820 to be coupled to the base 810 at different heights.

The support structure 800 includes a lock 840 that is selectively engageable with the leg 820. In this embodiment, the lock 840 includes a projection 842 that is configured to be inserted into the openings on the leg 820 and the sleeve 814. The lock 840 can be moved along the directions of arrow "T" either with or without the assistance of an actuator (not shown).

In an alternative embodiment, the projection 842 can be configured to engage only one side of the sleeve 814. For example, projection 842 can be configured to engage opening 822 in sleeve 814 only and not extend to the other side of the sleeve 814. In such an embodiment, the leg 820 can have openings only along one side, such as, openings 822, 826, and 830.

Figure 22:
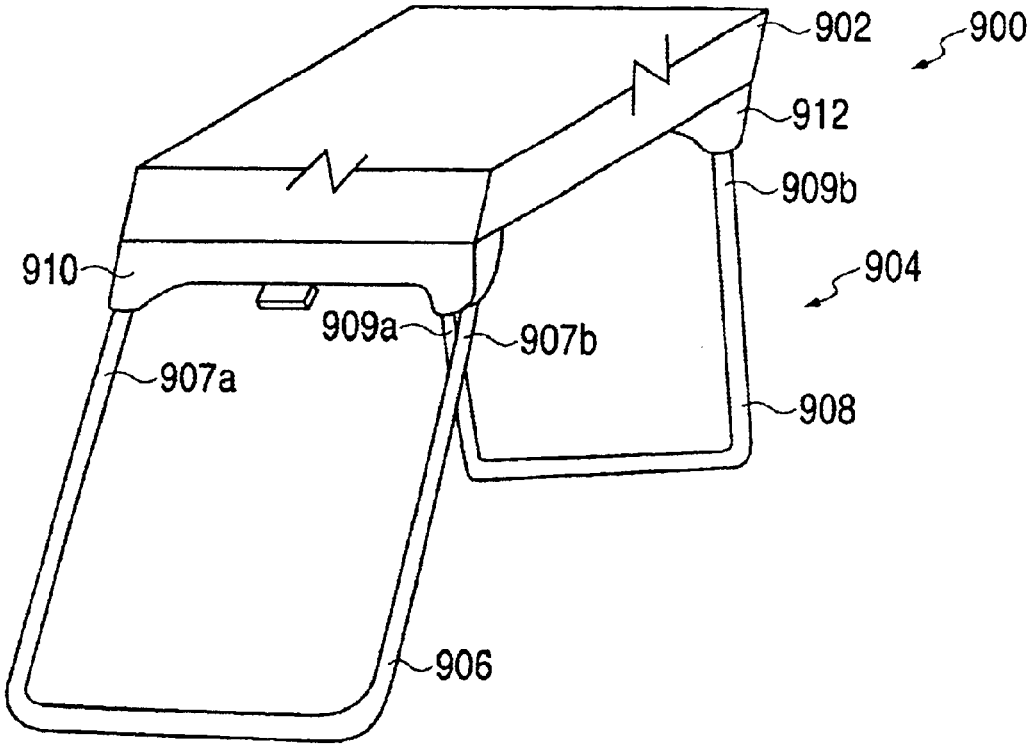
FIG. 22 is a front perspective schematic view of an alternative embodiment of a support structure according to the invention.
Figure 23:
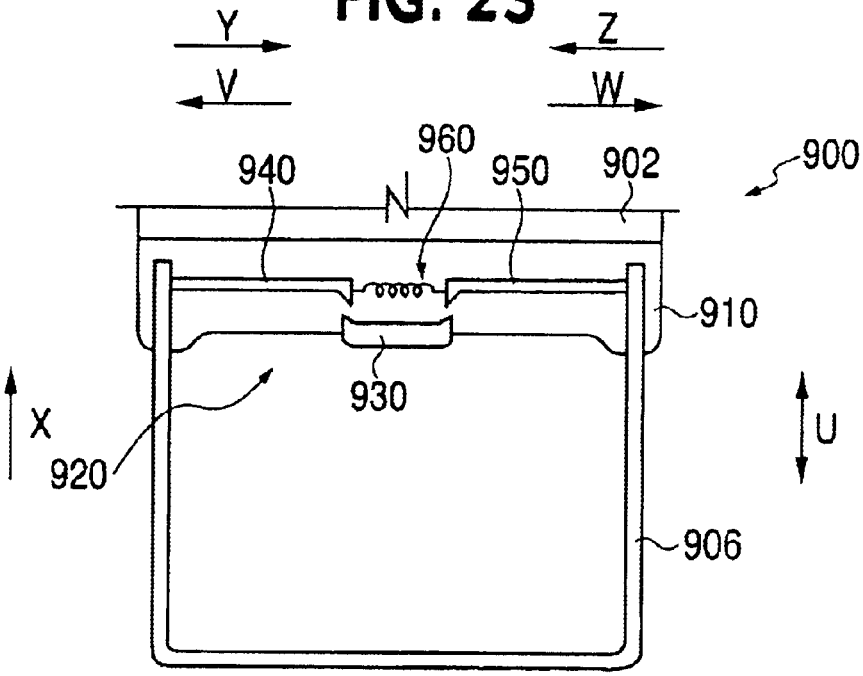
FIG. 23 is a front schematic view of the support structure of FIG. 22.

An alternative embodiment of a support structure according to the invention is illustrated in FIGS. 22 and 23. In this embodiment, the support structure 900 includes a support or seat 902 and a frame 904 that includes a front leg 906 and a rear leg 908. The front leg 906 includes front leg portions 907*a* and 907*b*. The rear leg 908 includes front leg portions 909*a* and 909*b*.

The support structure 900 includes a front coupler 910 to which the ends of front leg 906 are slidably coupled and a rear coupler 912 to which the ends of rear leg 908 are slidably coupled. The front coupler 910 and the rear coupler 912 can be coupled to any surface of the support 902, such as the lower surface. In one embodiment, each of the front coupler 910 and the rear coupler 912 can include a recess (not shown), the function of which is described later.

As illustrated in FIG. 23, front leg 906 is slidable relative to the front coupler 910 along the directions of arrow "U." While not illustrated, rear leg 908 is independently slidable relative to the rear coupler 912 along the same directions.

The support structure 900 includes a front height adjustment mechanism 920 and a rear height adjustment mechanism (not shown). The front and rear height adjustment mechanism have substantially similar structures and operations.

In this embodiment, height adjustment mechanism 920 is disposed in the front coupler 910. Height adjustment mechanism 920 includes an actuator 930 and locks 940 and 950. The actuator 930 can be located proximate to a recess in the front coupler 910 that facilitates access to the actuator 930. Locks 940 and 950 are biased outwardly along the directions of arrows "V" and "W," respectively, into engagement with the upper end portions of the front leg 906. In this embodiment, a biasing element 960, such as a spring, is disposed between the locks 940 and 950. In an alternative embodiment, separate biasing elements can be used to bias the locks individually.

When a user wants to change the height of the support 902 or the length of the front leg 906, the user moves actuator 930 along the direction of arrow "X." Movement of the actuator 930 in that direction causes the locks 940 and 950 to move inwardly along the directions of arrows "Y" and "Z," respectively. The front leg 906 can then be moved downwardly to align another set of openings in the upper ends of the front leg 906 with the projections on the locks 940 and 950. When the desired height of the support 902 is achieved, the actuator 930 is released and the locks 940 and 950 are biased into their extended or locked positions.

In alternative embodiments, a support structure may be disposed in any number of configurations. In such embodiments, the quantity of configurations is related to the quantity of positions in which the legs of the support structure can be disposed.

While the height adjustment mechanisms are illustrated as being operable in the same direction, in an alternative embodiment, the height adjustment mechanisms can be operable in different directions. For example, in the illustrated embodiment, the actuator is pressed upwardly to move the locks relative to the legs of the support structure. In an alternative embodiment, the actuator of one height adjustment mechanism can be oriented for actuation in an upward direction and the actuator of another height adjustment mechanism can be oriented for actuation in a downward direction.

In an alternative embodiment, the actuator of a height adjustment mechanism can be configured for movement in a substantially horizontal plane. Alternatively, the actuator can be oriented for movement in a plane disposed at an angle with respect to a horizontal plane.

In an alternative embodiment, the biasing elements of a height adjustment mechanism can be disposed at different locations. For example, the biasing elements can engage different surfaces of the locks to bias the locks in a particular direction. Alternatively, a biasing element can be disposed between the proximate ends of the locks to bias the locks outwardly and into engagement with the legs of the support structure.

In another embodiment, a biasing element, such as a spring, can be provided between an actuator and a base to bias the actuator away from the base.

In an alternative embodiment, a base of the support structure can include a single recess that enables access to an actuator in any one of the walls of the base. The recess can be any size and configuration that enables a user to actuate the height adjustment mechanism.

In an alternative embodiment, the actuator of a height adjustment mechanism can be accessible from a surface of the base other than lower surface. In one implementation, the actuator can be accessible via the front surface, the rear surface, or the top surface of a base.

In another embodiment, the support structure can include a single base in which one or more height adjustment mechanism are disposed.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. An infant support structure comprising:

a base, said base including a height adjustment mechanism;

a frame, said frame being coupled to said base, said frame including a first leg and a second leg, each of said first leg and said second leg being engageable with said base and being selectively engageable by said height adjustment mechanism substantially simultaneously; and a support, said support being coupled to said frame, the distance between said base and said support being adjustable upon activation of said height adjustment mechanism, said height adjustment mechanism including a first engaging member, a second engaging member, and an actuator, said first engaging member being configured to engage said first leg and said actuator, said second engaging member being configured to engage said second leg and said actuator, and movement of said actuator causes movement of said first engaging member relative to said first leg and of said second engaging member relative to said second leg.

2. The infant support structure of claim 1, said first engaging member including a first end and a second end, said first engaging member having a protrusion disposed proximate to said first end and a cam surface disposed proximate to said second end, said cam surface being contacted by said actuator when said actuator is moved by a user.

3. The infant support structure of claim 2, said first leg including a plurality of apertures configured to receive said protrusion, said actuator including an internal cam surface, and movement of said actuator causing said internal cam surface to contact said cam surface of said first engaging member and disengage said protrusion from said apertures of said first leg.

4. The infant support structure of claim 1, said base including first and second receiving portions, each of which is configured to slidably receive one of said first and second legs.

5. An infant support structure comprising:

a base, said base including a height adjustment mechanism;

a frame, said frame being coupled to said base, said frame including a first leg and a second leg, each of said first leg and said second leg being engageable with said base and being selectively engageable by said height adjustment mechanism substantially simultaneously; and a support, said support being coupled to said frame, the distance between said base and said support being adjustable upon activation of said height adjustment mechanism, said height adjustment mechanism including a first movable member, a second movable member, and a third moveable member, said first movable member being configured to engage said first leg, said second movable member being configured to engage said second leg, said third moveable member being configured to engage said first and second moveable members, and movement of said third movable member causing movement of said first and second movable members relative to said first and second legs, respectively.

6. The infant support structure of claim 5, said first leg having a longitudinal axis, said first movable member being movable in a direction substantially perpendicular to said longitudinal axis, and said first movable member being selectively disposable in a first position engaging said first leg and a second position spaced from said first leg.

7. The infant support structure of claim 6, said third movable member being movable in a direction at an angle with respect to said longitudinal axis of said first leg.

8. The infant support structure of claim 7, movement of said third movable member along a direction substantially parallel to said longitudinal axis causing said first movable member to disengage from said first leg.

9. The infant support structure of claim 5, said height adjustment mechanism including a biasing element, said biasing element biasing said first movable member into engagement with said first leg.

10. The infant support structure of claim 5, said first leg including a plurality of openings, said first movable member being selectively engageable with said plurality of openings.

11. The infant support structure of claim 5, said base defining a cavity, and said first movable member and said third movable member being disposed within said base cavity.

12. The infant support structure of claim 5, movement of said third movable member causing said first movable member to disengage from said first leg and said second movable member to disengage from said second leg.

13. An infant support structure comprising:

a first base, said first base including a first height adjustment mechanism;

a frame, said frame being coupled to said base, said frame including a first leg and a second leg, each of said first leg and said second leg being engageable with said first base and being selectively engageable by said height adjustment mechanism substantially simultaneously;

a second base, said second base including a second height adjustment mechanism, said frame including a third leg and a fourth leg, said third and fourth legs being engageable by said second height adjustment mechanism; and a support, said support being coupled to said frame, a distance between said first base and said support and a distance between said second base and said support being adjustable upon activation of said first height adjustment mechanism and said second height adjustment mechanism;

said first base being spaced from said second base a first distance when said frame is in a lowered configuration and said first base being spaced from said second base a second distance when said frame is in a raised configuration, said first distance being less than said second distance.

14. The infant support structure of claim 13, said legs of said frame being selectively disposable in retracted positions relative to said first and second bases when said frame is in said lowered configuration and in extended positions relative to said first and second bases when said frame is in said raised configuration.

15. An infant support structure comprising:

a frame, said frame including a first frame portion and a second frame portion, each of said first and second frame portions having an upper end and a lower end and having a length between said upper end and said lower end, said lower ends being configured to be placed on a support surface, said first frame portion including a first adjustment mechanism, said second frame portion including a second adjustment mechanism, said adjustment mechanisms being operable to enable a user to change the length of said first frame portion and the length of said second frame portion, said first frame portion including a first leg and a second leg, said first adjustment mechanism including an actuator and means for engaging said first leg, said actuator being operatively engageable with said means for engaging said first leg; and a support, said support being configured to support an infant, said support being coupled to said first and second frame portions proximate to said upper ends, said support being movable relative to the support surface in response to activation of said adjustment mechanisms.

16. The infant support structure of claim 15, said coupling member being configured to engage said first leg, and activation of said actuator causing said coupling member to disengage from said first leg.

17. The infant support structure of claim 15, said coupling member being disposable in an extended position and in a retracted position relative to said first leg, said coupling member engaging said first leg while in said extended position.

18. The infant support structure of claim 17, said coupling member being biased into said extended position.

19. An infant support structure comprising:

a front base, said front base including a first height adjustment mechanism, said first height adjustment mechanism including a first coupling mechanism and a first actuator;

a rear base, said rear base including a second height adjustment mechanism, said second height adjustment mechanism including a second coupling mechanism and a second actuator;

a frame, said frame including a front frame portion being coupled to said front base and a rear frame portion being coupled to said rear base, said front frame portion including a first leg and a second leg, said rear frame portion including a third leg and a fourth leg, said first leg and said second leg being engageable by said first coupling mechanism, said third leg and said fourth leg being engageable by said second coupling mechanism, movement of said first actuator disengages said first coupling member from said first leg and said second leg, and movement of said second actuator disengages said second coupling member from said third leg and said fourth leg; and a support, said support being coupled to said frame, the distances between said support and said bases being adjustable upon activation of said first and second height adjustment mechanisms.

20. The infant support structure of claim 19, said first coupling mechanism including a first elongate member and a second elongate member, said first actuator being operatively engageable with said first and second elongate members.

21. The infant support structure of claim 20, movement of said first actuator causing said first and second elongate members to move toward each other along said base and disengage from said first and second legs, respectively.

22. The infant support structure of claim 1, said height adjustment mechanism including means for engaging said frame and means for actuating said means for engaging said frame, said means for engaging said frame being configured to engage at least one of said first leg and said second leg, and movement of said means for actuating causing movement of said means for engaging.

23. An infant support structure comprising:

a support, said support including a height adjustment mechanism; and a frame, said frame being coupled to said support, said frame including a first leg portion and a second leg portion, each of said first leg portion and said second leg portion having a first end and a second end and a length between said first end and said second end, each of said first leg and said second leg being engageable with a coupler and being selectively engageable by said height adjustment mechanism substantially simultaneously, the length being adjustable upon activation of said height adjustment mechanism.

24. The infant support structure of claim 23, said height adjustment mechanism including means for engaging said frame and means for actuating said means for engaging said frame, said means for engaging said frame being configured to engage at least one of said first leg portion and said second leg portion, and movement of said means for actuating causing movement of said means for engaging.

* * * * *